United States Patent [19]

LaBate

[11] Patent Number: 4,740,241

[45] Date of Patent: Apr. 26, 1988

[54] DUAL ACTION LANCE FOR LADLES

[76] Inventor: Micheal D. LaBate, 115 Hazen Ave., Ellwood City, Pa. 16117

[21] Appl. No.: 52,975

[22] Filed: May 22, 1987

[51] Int. Cl.[4] ..... C21C 5/32

[52] U.S. Cl. ..... 266/225; 75/51.7; 75/53

[58] Field of Search ..... 75/51.7, 53; 266/225

[56] References Cited

U.S. PATENT DOCUMENTS

| | | | |
|---|---|---|---|
| 3,230,075 | 1/1966 | Nakamura | 75/59 |
| 3,945,820 | 3/1976 | Brotzmann et al. | 75/60 |
| 3,961,779 | 6/1976 | Tiberg et al. | 266/225 |
| 3,967,955 | 7/1976 | Folgero | 75/53 |
| 3,980,469 | 9/1976 | Forster | 75/53 |
| 4,179,103 | 12/1979 | Bentz et al. | 266/225 |
| 4,211,553 | 8/1980 | Honkaniemi et al. | 75/53 |
| 4,298,192 | 11/1981 | Barbakadze | 75/53 |
| 4,555,266 | 11/1985 | Wells | 75/53 |
| 4,588,170 | 5/1986 | Towns | 266/225 |

*Primary Examiner*—Peter D. Rosenberg
*Attorney, Agent, or Firm*—Harpman & Harpman

[57] ABSTRACT

A method of introducing and mixing a refining agent into molten metal in a ladle using a lance having a refractory body shaped to facilitate the positioning of the lance in the ladle is disclosed. Several tubular members are positioned within the lance and communicate with vertically spaced openings in a common plane in a lower side wall thereof communicating with the interior of the ladle and the molten metal therein. Some of the openings are plugged with porous material and others form passageways for the refining agent such as an alloy wire or powder. Gas, such as argon, is introduced through the tubular members having porous plugs and delivered through the porous plugs so as to bubble upwardly through the molten metal around the other openings and the refining agent delivered therethrough in a stirring and mixing action beginning adjacent the bottom of the ladle.

5 Claims, 1 Drawing Sheet

DUAL ACTION LANCE FOR LADLES

DESCRIPTION OF THE INVENTION

1. Technical Field

This invention relates to a method and apparatus for simultaneously introducing a refining agent and bubbling gas, such as argon, through molten metal in a ladle so as to immediately mix the refining agent in the molten metal.

2. Background Art

Apparatus for introducing gases into molten metal for various purposes are disclosed in U.S. Pat. Nos. 3,230,075 and 3,945,820, which disclose immersion lances for refining metal melts in hearth-type vessels. Apparatus for introducing gas into a ladle is disclosed in U.S. Pat. No. 3,961,779 and a lance useful for the same practice is disclosed in U.S. Pat. No. 4,179,103. A lance for refining a melt by means of a pulverous solid material and a carrier gas is disclosed in U.S. Pat. No. 4,211,553, and a lance positioned in a ladle in fixed relation to the side wall thereof is disclosed in U.S. Pat. No. 4,588,170.

In the prior art U.S. Pat. Nos. 3,230,075 and 3,945,820, the lances are introduced through an angularly arranged opening in the side wall of a hearth vessel and a similar arrangement for introducing a lance into a ladle is disclosed in U.S. Pat. No. 3,961,779.

The other prior art inventions referred to hereinbefore are arranged to be positioned directly into the open top of the ladle and no prior art is known wherein a modified lance construction enables it to be used to simultaneously introduce and mix a refining agent into the molten metal in a ladle at or near the bottom thereof so that the bubbling gas, such as argon, emerging below the refining agent will always create a desired mixing and stirring action of the refining agent and the molten metal in the ladle which is essential in deoxidizing and desulphizing or otherwise treating the molten metal as the case may be.

SUMMARY OF THE INVENTION

The present invention provides a refining agent conveying and gas bubbling lance having an elongated refractory body member which is cross sectionally square and/or rectangular and particularly suited for positioning vertically in a ladle in which molten metal is transported. Tubular members extend longitudinally of the lance and communicate with several outward openings therein near the lower end thereof which are arranged in vertically aligned relation to one another. Some of the openings are plugged with porous plugs or other gas delivering means and others are open so that a refining agent can be introduced into the molten metal therethrough. The tubular members extend outwardly of the upper end of the lance for establishing communication with the source of argon or other gas and a source of a refining agent which when introduced into the lance will emerge in separate controlled streams from the openings therein to create a highly desirable mixing and stirring action in the molten metal being transported by the ladle so that the refining agent can immediately and completely react therein.

DESCRIPTION OF THE PREFERRED EMBODIMENT

Figure 2:
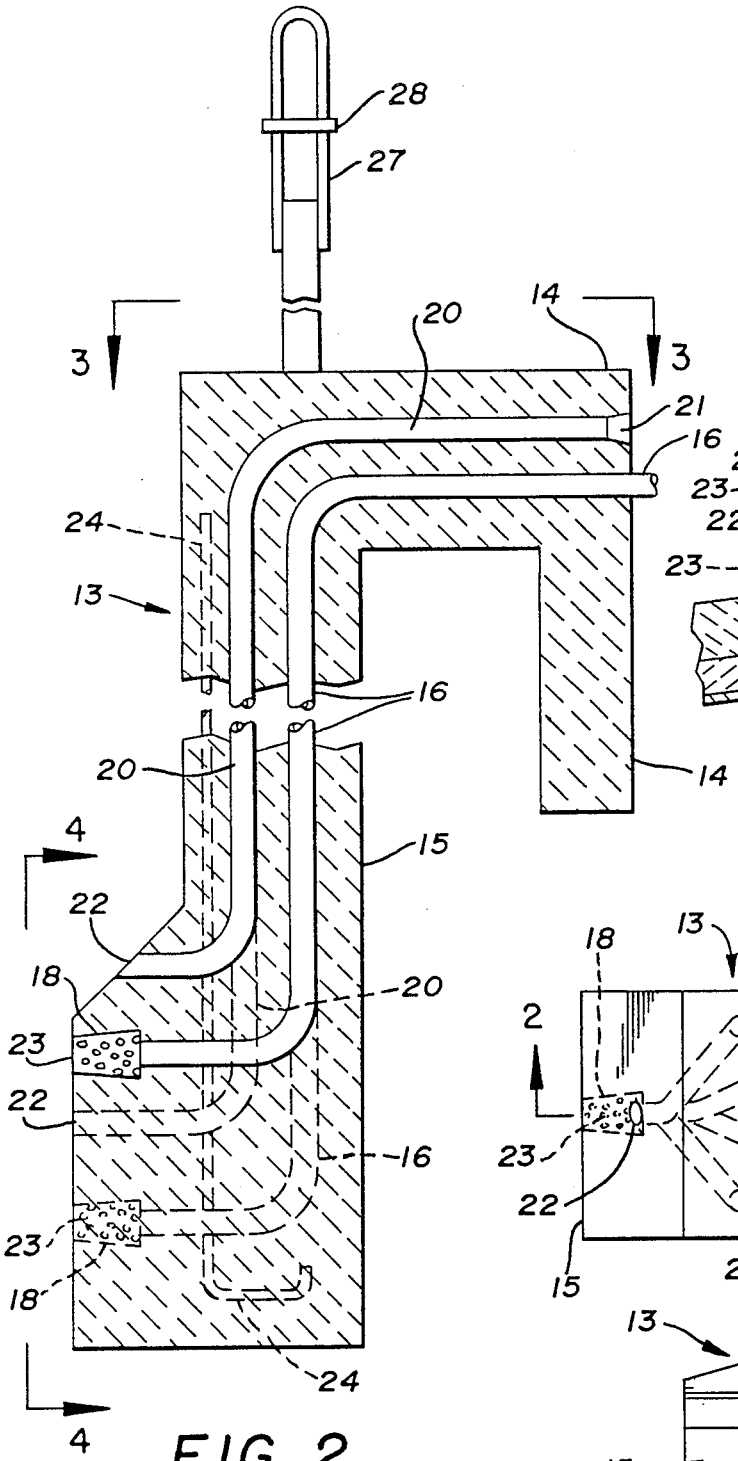
FIG. 2 is an enlarged side elevation of the dual action lance with parts broken away and parts in cross section.
Figure 1:
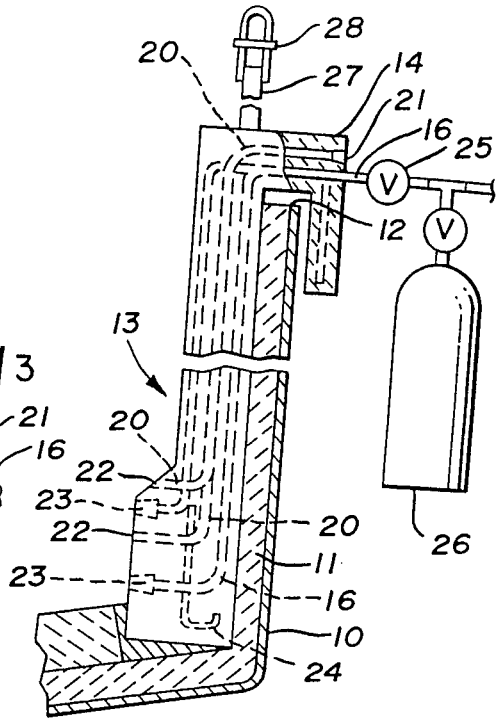
FIG. 1 is a side elevation of a portion of a ladle showing the dual action lance positioned therein with parts broken away.
Figure 3:
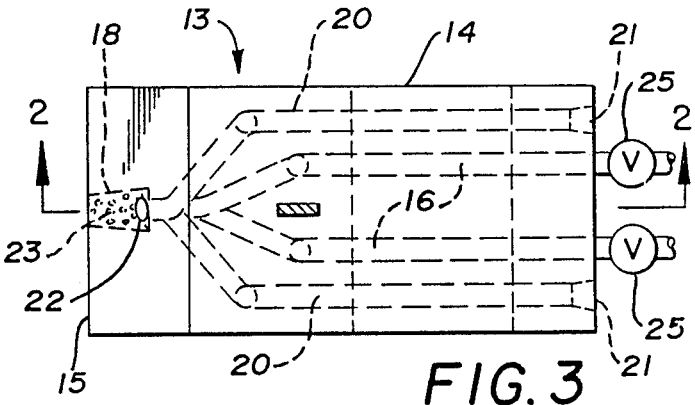
FIG. 3 is a top plan view on line 3—3 of FIG. 2.

By referring to the drawings and FIGS. 1 and 2 in particular, it will be seen that a portion of a ladle 10 has been disclosed which is a vessel of any suitable or conventional construction as well known in the steel making industry. The ladle 10 has a protective refractory lining 11 such as refractory brick or the like. The upper end of the ladle 10 is illustrated at 12. The lance comprises an elongated refractory body member generally indicated at 13 and having an upper portion 14 which is of inverted U-shape and a lower portion 15 which is cross sectionally rectangular. Tubular members 16 formed of pipe are positioned longitudinally in the elongated refractory body member of the lance 13 and extend outwardly of the upper portion 14 thereof and communicate with vertically spaced and aligned openings 18 in the lower portion 15 thereof. Secondary tubular members 20, also formed of pipe, are positioned longitudinally in the elongated refractory body member of the lance 13 and communicate with vertically spaced and aligned openings 22 in the upper and lower portions 14 and 15 respectively of the lance 13. The openings 18 and 22 are on a common vertical plane.

By referring to FIG. 1 of the drawings, it will be seen that one vertical surface of the lance 13 is positioned against the refractory lining 11 of the ladle 10 and the inverted U-shaped upper portion 14 of the lance 13 is hooked over the upper end 12 of the ladle 10 so as to hold the lance 13 securely in position.

By referring to FIGS. 1 and 2 of the drawings, it will be seen that the lower ends of the tubular members 16 communicate with porous plugs 23 positioned in the openings 18 in the lower portion 15 of the lance 13 and that the lower ends of the secondary tubular members 20 defined by the openings 22 in the lower portion 15 of the lance 13 are simply open so that the refining or reaction agent or agents may be delivered outwardly therefrom.

Figure 4:
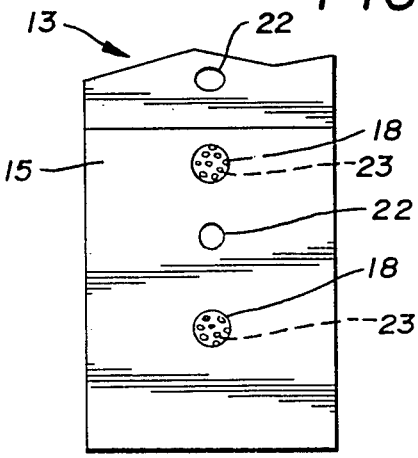
FIG. 4 is a side view on line 4—4 of FIG. 2.

Still referring to FIGS. 1 and 2 of the drawings, and FIG. 4 of the drawings, it will be seen that each of the openings 22 are located vertically above the openings 18 in which the porous plugs 23 are positioned and through which argon gas or the like is introduced into molten metal in the ladle 10.

It will be thus be seen that the simultaneous introduction of the refining agent such as aluminum or any metallurgical alloy in wire or powder form through the openings 22 will be immediately dispersed to the maximum degree through the molten metal in the ladle by the action of the argon or other gas introduced immediately below the refining agent and adjacent the bottom of the ladle. It will occur to those skilled in the art that such introduction of the refining agent or agents at or near the bottom of the ladle with the simultaneous introduction of the argon gas or the like, effectively treats all of the molten metal from the bottom up as the refining agent and gas rise through the total molten mass.

It will also occur to those skilled in the art that a highly reactive agent can be introduced near the bottom of the ladle by the method and apparatus disclosed herein, whereas the prior art practice of introducing reactive agents into the molten mass often results in pre-ignition and loss of the reaction desired. This is particularly true of desulphurizing or grain refining or shaping or homogenizing agents which can, with the present invention and apparatus, be introduced into the bottom of the molten metal and thoroughly dispersed therein prior to any pre-ignition that otherwise occurs.

Again referring to FIG. 2 of the drawings, it will be seen that the upper end of the tubular members 16 extend outwardly of the inverted U-shaped upper portion 14 of the lance 13 and communicate with valves 25 and a source of argon, or other gas, which may be a cylinder gas source 26 rendering the apparatus portable. While not illustrated, the refining agent or agents in wire or powder form are introduced into the secondary tubular members 20 through the openings 21 by suitable means that insures their introduction into the molten metal when they emerge from the openings 22 in the lower portion 15 of the lance. A reel mechanism serves to suitably feed wire forms of the refining agent and an additional supply of argon or other gas under suitable pressure will serve to insure the injection of powdered form of refining or reactive agents by the tubular members or conduits 16 and 20.

Still referring to FIGS. 1 and 2 of the drawings, it will be seen that an inverted U-shaped handle 27 is attached to the upper portion 14 of the lance 13 and extends above the upper portion 14 so that the lance 13 can be conveniently attached to a supporting and positioning device and held thereby as the lance 13 is positioned in the ladle with the inverted U-shaped upper portion 14 thereof acting to hold the lance 13 against the side wall of the ladle 10.

It will occur to those skilled in the art that additional openings for the introduction of argon or another gas and a refining or reaction agent may be provided in the lower portion 15 of the lance and in communication with additional tubular members in the lance which in turn communicate with the hereinbefore mentioned sources of the refining or reactive agents or additives and gas.

It will also occur to those skilled in the art that the conduits or tubular members 16 through which the refining or reactive agents or additives are introduced with a propelling agent can be of any configuration through which the agents or additives can be moved. While the illustration of the preferred embodiment shows the conduits 16 as having turns of about 90° radius, the turns may be greater to assure the relative friction free movement of wire forms of additives, etc.

It will further be observed that the novel and highly efficient dual action lance is ideally suited for side mounting in a transport ladle for molten metal as it will maintain its desired position and effectively introduce the refining and/or reaction agents and the argon or other propelling gas into the ladle and the molten metal therein at points near the bottom of the ladle and that the design of the dual action lance enables it to occupy a minimum of space therein such as for example mounting the same in a vertical groove in the refractory lining of the side of the ladle as disclosed in U.S. Pat. No. 4,588,170.

Having thus described my invention, what I claim is:

1. Apparatus for refining molten metal including:

a vessel and a lance supported by and held substantially vertically in the vessel and terminating adjacent the bottom of said vessel for the separate subsurface injection of refining and stirring agents into molten metal in the vessel;

the lance including at least a pair of conduits surrounded by a refractory material;

one of the pair of conduits communicating at one end with a source of said refining agents and terminating in an unobstructed right angular opening above the bottom of said lance, the other of said pair of conduits communicating at one end with a source of gas and terminating in a right angular opening below said unobstructed opening;

a portion of said refractory material extending across a portion of the top of said vessel in a hook shape for engagement thereover.

2. The apparatus of claim 1 wherein the conduits are pipes and the refractory material is formed thereabout.

3. The apparatus of claim 1 wherein the conduits are pipes and the refractory material is formed thereabout, the pipes and refractory material extending across the top of the vessel and the pipes extending out of said hook shape on one side thereof.

4. The apparatus of claim 1 wherein said opening below said unobstructed opening is enlarged and a porous plus is positioned in said enlarged opening so as to form multiple openings to create bubbles of the gas introduced therethrough below and around and above said unobstructed opening.

5. The apparatus of claim 4 wherein there are at least two unobstructed openings and at least two openings therebelow and wherein said unobstructed openings and the openings therebelow are positioned in vertically arranged spaced relation to one another.

* * * * *